US005526251A

United States Patent [19]

Andre et al.

[11] Patent Number: 5,526,251

[45] Date of Patent: Jun. 11, 1996

[54] EMERGENCY LIGHTING CONNECTIONS

[75] Inventors: Gary S. Andre, Conyers; Andrew E. Masters, Lawrenceville; Stephen T. Smith, Conyers, all of Ga.

[73] Assignee: National Service Industries, Inc., Atlanta, Ga.

[21] Appl. No.: 343,775

[22] Filed: Nov. 22, 1994

[51] Int. Cl.[6] ..... F21S 1/02

[52] U.S. Cl. ..... 362/396; 362/147; 362/368; 362/404; 362/812; 248/906; 40/541; 40/570; 439/537

[58] Field of Search ..... 362/812, 368, 362/370, 404, 147, 457, 458, 226; 40/570, 558, 572, 573, 574, 575, 571, 546, 563, 584; 439/537, 536; 248/906

[56] References Cited

U.S. PATENT DOCUMENTS

| | | | |
|---|---|---|---|
| 3,402,494 | 9/1968 | Gray . | |
| 3,478,455 | 11/1969 | Fremont . | |
| 3,665,626 | 5/1972 | Lund et al. . | |
| 3,772,527 | 11/1973 | Darling et al. . | |
| 3,924,344 | 12/1975 | Davis . | |
| 3,931,689 | 1/1976 | Shine . | |
| 4,071,749 | 1/1978 | Balogh | 362/20 |
| 4,162,779 | 7/1979 | Van Steenhoven | 362/404 |
| 4,222,093 | 9/1980 | Garcia | 362/404 |
| 4,255,746 | 3/1981 | Johnson et al. | 362/183 |
| 4,355,479 | 10/1982 | Thornton | 40/570 |
| 4,466,208 | 8/1984 | Logan, Jr. et al. | 40/544 |
| 4,561,203 | 12/1985 | MacDonald, Jr. et al. | 40/570 |
| 4,600,972 | 7/1986 | MacIntyre | 362/20 |
| 5,018,290 | 5/1991 | Kozek et al. | 362/812 |
| 5,247,756 | 9/1993 | Johnstone | 40/570 |
| 5,272,605 | 12/1993 | Johnstone | 362/147 |
| 5,376,020 | 12/1994 | Jones | 362/812 |

FOREIGN PATENT DOCUMENTS

0412281A1 2/1991 European Pat. Off. .

OTHER PUBLICATIONS

Brochure, "Kast Exits—Stencil or Plastic Face," Incandescent Catalog, Lithonia Lighting, Inc. p. 26 (1965).

Brochure, "Fail-Safe Exit Sign," Lithonia Lighting (1971).

Brochure, "Exit Series—Plastic Face," Lithonia Lighting, p. 64, (1971).

Brochure, "ES/EP Premium Exits," Lithonia, p. 52 (1980).

Brochure, "AS/AP Incandescent Series," Lithonia Emergency Lighting, p. 24, (1984).

Installation Instructions, "Spectrum Series Model MS/MP 120/277 Exit Signs," Lithonia Emergency Systems (Jul. 28, 1986).

Drawing, "L.A. Swivel Male," (Jul. 7, 1986).

One page of photographs, Lithonia Lighting Systems Emergency Exit Sign as shown in Brochure, "Spectrum Series—Emergency Exit," Lithonia Emergency Systems (1987) listed above.

(List continued on next page.)

*Primary Examiner*—James C. Yeung
*Assistant Examiner*—Thomas M. Sember
*Attorney, Agent, or Firm*—Kilpatrick & Cody; James L. Ewing, IV

[57] ABSTRACT

Emergency lighting housing/canopy interfacing structure. The structure employs one or more fasteners which may be positioned into place quickly and simply without the aid of tools in order to retain the housing and canopy securely together. Additional redundance members such as conventional snap-fitting barb members may additionally be employed to assist in installation and for extra safety. The present invention accordingly provides emergency lighting housing/canopy interfaces which allow simple, quick and reliable installation of emergency lighting fixtures, but which add additional structure to support the housing and the considerable load imparted by transformers, batteries and other structure within the housing. A preferred embodiment includes an elongated fastener which may be snapped and rotated into place into mounting posts formed on the canopy. The mounting posts, which protrude into the housing, are thus cammed into place against the housing in order to bias the housing and the canopy securely together.

32 Claims, 4 Drawing Sheets

OTHER PUBLICATIONS

One page of photographs, Lithonia Lighting Systems Emergency Exit Sign with Chevrons as shown in Brochure, "Introducing the New QM-EL Quantum Emergency Exit Sign," Lithonia Lighting (1992) listed above (Chevron Sign).

One page of photographs, Model KSR-LED EZ-Snap Series Exit Sign, Dual Lite (Oct. 26, 1994) ("Dual Lite Sign") as shown in Installation Instructions, EZ-Snap LED Exit Signs, Dual-Lite (Jul. 1994) listed above.

One page of photographs, (Cam Attachment (Long)) shown in Drawing, "Pin, Locking, Pedestal Swivel," (Mar. 30, 1989) and Brochure, Installation Instructions Titan Series (Circa 1989), listed above.

One page of photographs (Cam Attachment (Short)) shown in Drawing, "Swivel, Lamp Par 36," (Oct. 5, 1993) listed above.

Copy of photograph of Swivel shown in Drawing, "L.A. Swivel Male," (Jul. 7, 1986) listed above.

One page of photographs, canopy/backplate shown in Brochure, "Dual-Lite Excite™ Simply Beautiful," Dual-Lite, Inc. (Jul. 1980) listed above.

One page of photographs, canopy housing shown in Brochure, "Introducing the Quantum Difference," Lithonia Emergency Systems (1989) listed above.

Brochure, "6 Volt Self-Powered Economy Exit Light—Series EP," Elan Lighting Products Division of Altus Corporation (Apr. 1982).

Brochure, "6 Volt Combination Emergency Light/Exit Sign—Series ED," Elan Lighting Products Division of Altus Corporation (Apr. 1982).

Brochure, "Standard and AC-DC Exit Signs—Series WX & BX," Elan Lighting Products Division of Altus Corporation (Sep. 1982).

Brochure, "Chloride . . . the quality innovators—Signout Self-powered AC/DC exit signs," Chloride Systems, (Sep. 1982).

Brochure, "Universal Module Exit Signas—XU Series, AC or AC/DC," Teledyne Big Beam, (Mar. 1989).

Brochure, "Universal Module Exit Signs—XU Series, AC or AC/DC," Teledyne Big Beam, (Aug. 1990).

Brochure, "Dynaray Emergency Lighting—81 Series," Electro Powerpacs Corp. (Jun. 1990).

Brochure, "The New Siltron UX Series—Extruded Aluminum Sealed Maintenance-Free Nickel Cadmium Batteries," Siltron Illumination, Inc. (undated).

Brochure, "Fluorescent Emergency Light Power Pack—CFP Series," Chloride Systems, pp. 11-18, (undated).

Brochure, "Chloride . . . Life Safety Products & Systems—Total Flexibility in a Single Exit Sign," Chloride Systems (undated).

Linn, Charles A I A, "From 'Frog Eyes on a Lunch Box' to Subtle, Quality Emergency Fixtures," Lighting Update, *Facilities Design & Management*, p. 47 (undated).

Installation Instructions, "EZ-Snap LED Exit Signs," Dual-Lite (Jul. 1994).

Drawing, "Pin, Locking, Pedestal Swivel," (Mar. 30, 1989).

Brochure, "Installation Instructions Titan Series," (Circa 1989).

Drawing, "Swivel, Lamp Par 36," (Oct. 5, 1993).

Brochure, "Open the Door to a Spectrum™ of Opportunity," Lithonia Emergency Systems, (1987).

Brochure, "Spectrum Series—Contemporary Injection Molded Emergency Exit Signs," Lithonia Emergency Systems (1987).

Brochure, "Spectrum Series—Emergency Exit," Lithonia Emergency Systems (1987).

Brochure, "Introducing the Quantum Difference," Lithonia Emergency Systems (1989).

Brochure, "FAS/FAP Fluorescent Series," Lithonia Emergency Lighting, p. 25, (undated).

Brochure, "Introducing The New QM-EL Quantum Emergency Exit Sign," Lithonia Lighting (1992).

Brochure, "Your Choice of Exit Signs Can Make a World of Difference," Lithonia Lighting (1993).

Installation Instructions and Supplement, "Quantum™ Series—Model M 120/277 Exit Signs," Lithonia Emergency Systems, (undated).

Installation Instructions,"QM-EL Emergency Exit Signs," Lithonia Emergency Systems (undated).

Brochure, "Dual-Lite EXITE™ Simply Beautiful," Dual-Lite, Inc., (Jul. 1980).

Brochure, "Excalibur® Series," Dual-Lite, (undated).

Brochure, "Excite™ Series," Dual-Lite, (Mar. 1988).

Brochure, "EZ-Snap™ Series," Dual-Lite, (Sep. 1990).

Installation Instructions, "Dual-Lite EZ-SNAP® Exit Signs," (Jan. 1994).

Brochure, "Single and Dual Lamp Fluorescent AC and Emergency Universal Mounting Exit Signs," pp. 27-28, (undated).

EMERGENCY LIGHTING CONNECTIONS

The present invention relates to emergency lighting fixtures and more particularly to structures for connecting emergency lighting canopies and housings together.

BACKGROUND OF THE INVENTION

Improved manufacturing techniques, customer sophistication, and rising labor costs continue to engender developments in emergency lighting. Conventional emergency lighting fixture housings have been connected to their canopies (which in turn are mounted to junction boxes or other structure within or on a wall, ceiling or other surface) using elongated threaded metal conduit with retaining nuts. That structure, which is similar to the threaded conduit used in other lighting fixtures such as ceiling and lamp fixtures, is characteristically difficult and time consuming to install. Furthermore, pliers or other tools must be employed to torque the nut that secures the housing to the canopy. A secure fit is important because the emergency lighting must remain in place for many years with minimum risk of failure. Among other things, relative movement between the canopy and the housing can, over time, subject wiring and insulation to cyclical stresses which, when combined with temperature excursions, can create failure of the wiring and/or the insulation to create either an open circuit or a short and thus failure of the emergency lighting.

Recent developments include emergency lighting in which the canopies feature mounting posts that in turn contain barbs or snaps which protrude into the housings, snap into place and retain the housings against the canopies. Such retention may be made secure if the housing body is caused to flex against certain structure of the canopy, although stresses induced in the housing structure from such flexion may be exacerbated over time if the fixture is subjected to undue temperature excursions and/or vibration. Furthermore, a typical housing usually contains batteries for emergency backup lighting, as well as transformers, and thus can impose considerable load on the small snap surface area which retains the housing aloft. Nevertheless, such snap fittings are advantageous to the extent that they eliminate the need for installation tools and thus save installation time, effort and expense.

SUMMARY OF THE INVENTION

The present invention employs fasteners which may be conveniently positioned into place to secure emergency lighting fixture housings to their canopies without the need for tools. The fasteners constitute structure separate from the housing or canopy structure, and they increase the surface area of the interface that supports the housing. That larger surface area creates additional assurance that the housing, together with its considerable battery and transformer weight, will be retained aloft securely for many years during the service life of the fixture. The fasteners may be supplemented with snap-fitting or any other desired redundance structures in order to allow easier installation and in order to provide a backup support in the unforeseen case that a fastener fails.

It is accordingly an object of the present invention to provide emergency lighting fixture housing and canopy interface structure which may be installed without tools, which constitutes structure separate from the housing or the canopy, and which creates a secure fit of the housing to the canopy.

It is an additional object of the present invention to provide safer emergency lighting housing/canopy interfaces.

It is an additional object of the present invention to provide emergency lighting housing/canopy interfaces which allow simple, reliable and quick installation of the emergency lighting.

It is an additional object of the present invention to provide redundant emergency lighting housing/canopy interfaces which may employ snap-fit structures for easier installation and greater safety.

Other objects, features and advantages of the present invention will become apparent with respect to the remainder of this document.

DETAILED DESCRIPTION OF THE DRAWINGS

Figure 1:
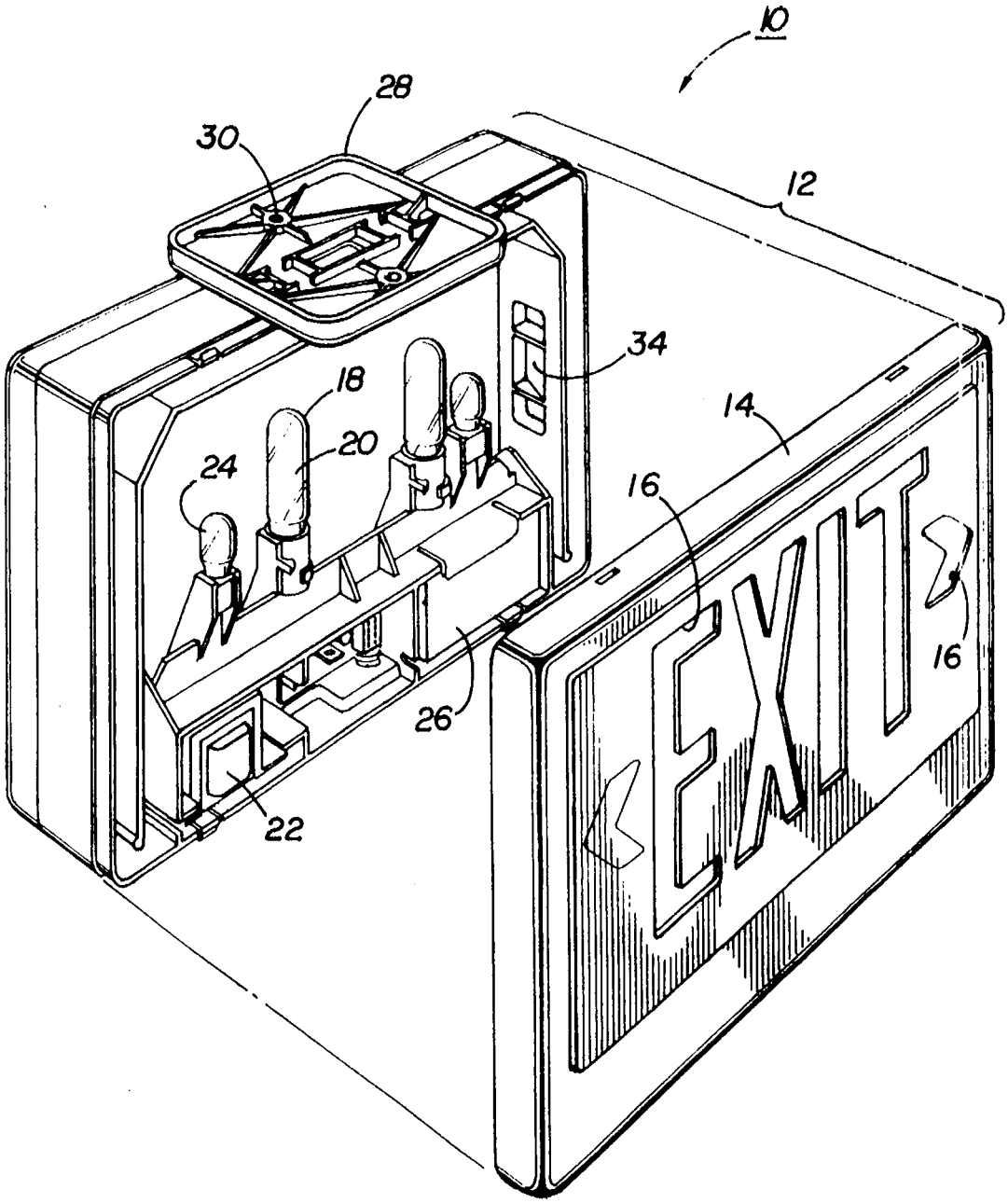
FIG. 1 is a perspective view of an emergency lighting fixture according to a preferred embodiment of the present invention.

FIG. 1 shows emergency lighting fixture 10 according to a preferred embodiment of the present invention. FIGS. 2–6 show aspects of that structure in greater detail. Fixture 10 includes a housing 12 which may be considered to include one or more face plates 14. The face plates 14 in turn contain indicia 16 such as the word "EXIT" as used in English speaking countries, or other indicia such as a depiction of a running person and, where appropriate, chevrons which may be snap-in type as desired. Indicia 16 are typically illuminated by illumination sources 18 which may be, for instance, incandescent bulbs, LEDs, or as otherwise desired. A first set of illumination sources 20 operates off of mains power with voltage stepped down as desired using one or more transformers 22. A second set of illumination sources 24, often lower power than first illumination sources 20, operates from one or more batteries 26 which may be trickle charged using mains current and include test circuits as necessary in order for maintenance personnel periodically to establish that second illumination sources 24 activate when mains power fails. The transformer and the battery typically weigh considerably and thus make it important for housing 12 to be connected in a reliable fashion to supporting structure.

Conventionally, a canopy 28 such as shown in FIG. 1 is employed to mount housing 12 to a mounting surface such as a wall, ceiling or other supporting surface. The canopy 28 contains structure for bolting or otherwise connecting to a junction box or other appropriate mounting surface structure. The connection structure shown in the present embodiment employs a number of openings 30 to which fasteners may be inserted for connection to a junction box. Other desired structure may be employed. Canopy 28 also lends aesthetic effect by covering the mounting surface structure, such as junction box internals, which support fixture 10 structurally.

Construction or renovation projects often require installation of hundreds of emergency lighting fixtures. Accordingly, simple, quick and reliable installation is critical. Conventional measures, which employ elongated threaded conduit which is adapted to screw into a junction box, require the worker to thread wires through the conduit and, simultaneously, thread a nut onto the cylinder and torque it into place using pliers. Conventional recent improvements over the elongated conduit/junction box approach employ mounting posts 32 extending from canopy 28. These posts 32 protrude into mounting openings 34 which are formed in housing 12 and are adapted in size and shape to receive the posts 32 snugly. Redundancy members 36, discussed more fully below, may also be employed; FIGS. 2–6 show barb members 36 adjacent to posts 32, which barbed members are adapted to snap into place against the housing 12 to hold it aloft and to aid installation. The mounting openings 34 may be included on the top and sides of the housing 12 in order to accommodate ceilings and walls.

Even a cursory inspection, however, shows that the cross-sectional area 38 of the barbed members 36 which contact housing 12 in order to suspend housing 12, with its transformer and batter weight, is small. Fasteners 42 according to the present invention supplement that area. Nevertheless, it is desirable to include barbed members 36 in the housing/canopy interface 40 to allow housing 12 to be suspended in place during installation and pending positioning of more secure fasteners 42. Barbed members 36 may be more universally considered as redundance members 36 which, after installation of fasteners 42, serve as a backup in case of inadvertent failure of fasteners 42 in order to retain housing 12 aloft. Redundance members 36 may be snap-fit or any other desired simple, quick connection. Redundance members 36 may form a part either of housing 12 or canopy 28 (or be separate) as desired.

Figure 2:
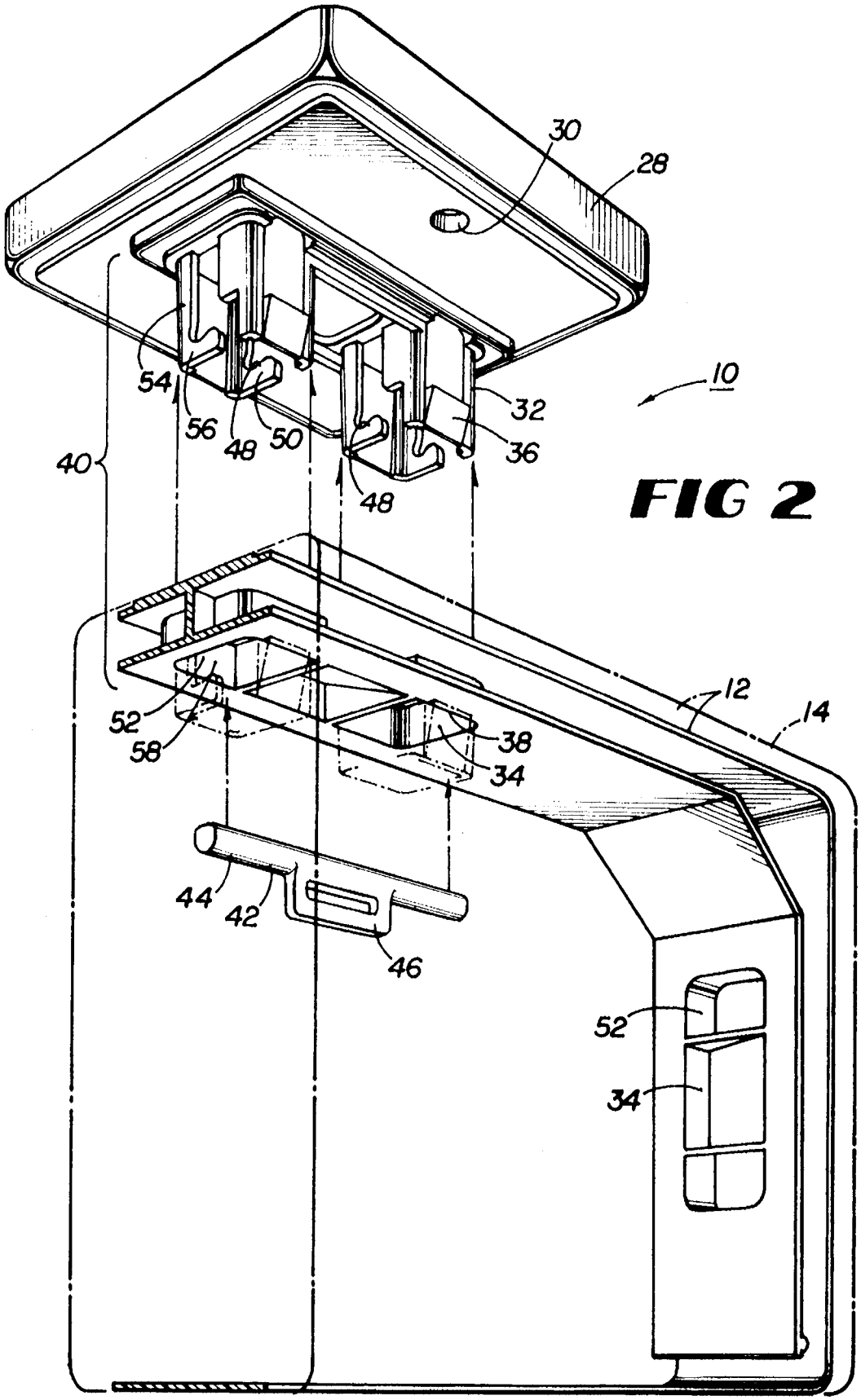
FIG. 2 is a partial perspective/cut-away view of a portion of the housing and the canopy of FIG. 1.
Figure 3:
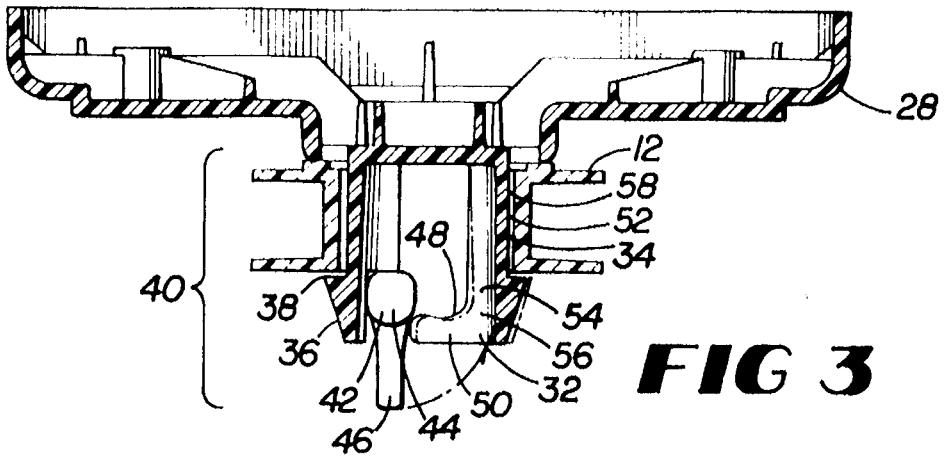
FIG. 3 is a cross-sectional view of the interface of the housing and canopy of FIGS. 1 and 2.
Figure 4:
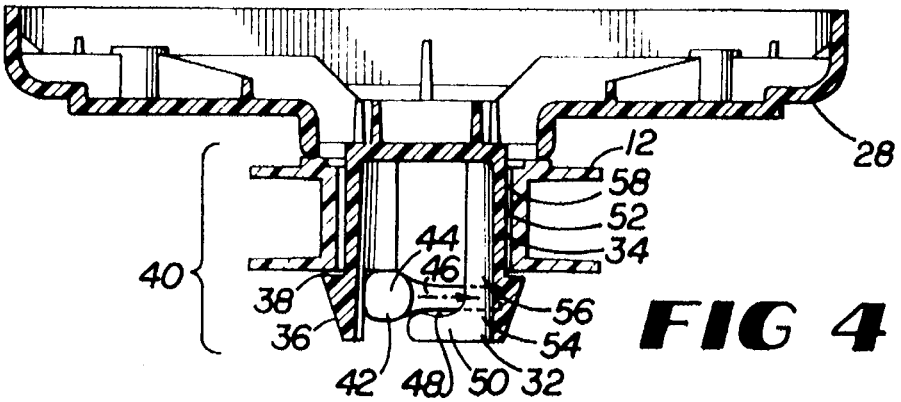
FIG. 4 is a cross-sectional view of the interface of the housing and canopy of FIGS. 1 and 2 in which the fastener has been rotated so that it may be inserted into place.
Figure 5:
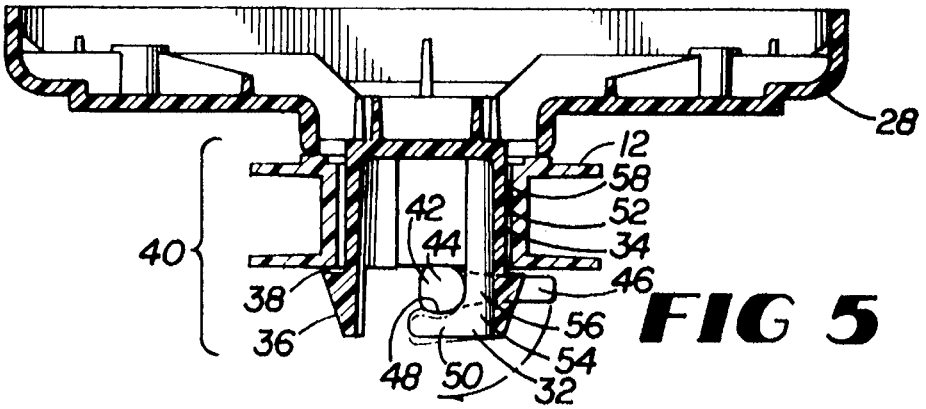
FIG. 5 is a cross-sectional view of the interface of the housing and canopy of FIGS. 1 and 2 in which the fastener has been snapped into place.
Figure 6:
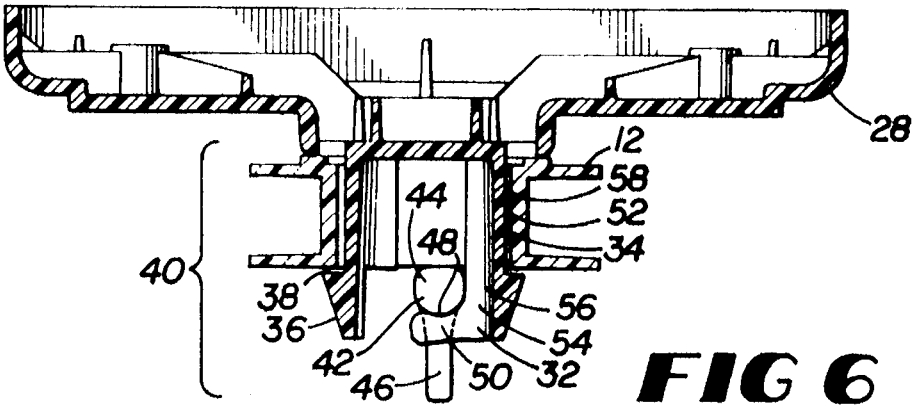
FIG. 6 is a cross-sectional view of the interface of the housing and canopy of FIGS. 1 and 2 in which the fastener has been rotated into place to cam the housing against the canopy.

FIG. 2 shows a fastener 42 according to a preferred embodiment of the present invention. Fastener 42 comprises an elongated cammed member 44 which is structurally separate from housing 12 and canopy 28. Cammed member 44 contains a tab 46 for manipulation of fastener 42 into place in order to secure housing 12 to canopy 28. The generally flat or neutral surface shown on the cammed member 44 in FIGS. 2–6, which is opposite the tab 46, may be thought of as an over center area bordered by two cams which are generally located at between approximately 090 and 170 degrees from the tab. This neutral surface causes cammed member 44 to stabilize rotationally against housing 12 when fastener 42 has been rotated into locked or installed position as shown in FIG. 6. Not only does this mechanism tend to lock fastener 42 into place when installed, but it also provides a tactile indication to the installer that the fastener 42 is properly in place. The cam structure is additionally useful to bias housing 12 against canopy 28 in order to reduce potential effects of vibration and obtain a firmer fit, although such biasing is not necessary in any fastener 42, whether or not according to the type shown in FIG. 2. Additionally, camming is only one form of structure which may be employed to accomplish such biasing in a rotational fashion. Tabs 46 are additionally optional, and other structure may be employed just as easily. In the embodiment shown in FIGS. 2–6, fastener 42 fits into adaptations 48 which take the form of substantially L-shaped slots. FIGS. 3–6 show a sequence in which fastener 42 may be positioned into place to secure housing 12 to canopy 28. As shown in FIG. 3, fastener 42 is inserted in adaptations 48 and then rotated 90° as shown in FIG. 4 so that it may be snapped into place easily as shown in FIG. 5. Then, when in place and retained by hooks 50 forming part of adaptations 48, as shown in FIG. 6, fastener 42 is rotated 90° to cam housing 12 against hooks 50 of adaptations 48 and thus stabilized against canopy 28, providing the installer with a tactile indication that fastener 42 is properly in place.

Fasteners 42 may take the form of any desired structure. For instance, as in FIG. 7, they may take the form of one or more pins or dowels 51 of uniform or varying cross section which may be received by and cooperate with openings such as holes 53 formed in mounting posts 32, in order to retain housing 12 against canopy 28.

Figure 8:
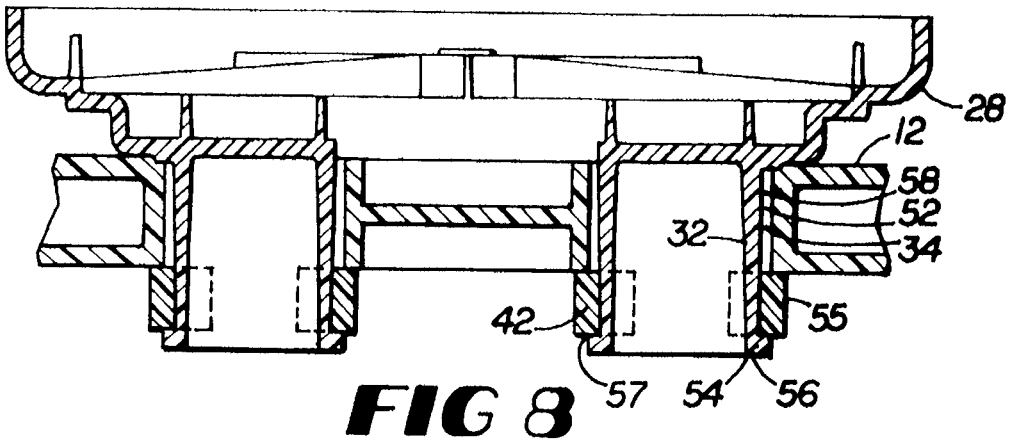
FIG. 8 is a cross-sectional view of a third embodiment of a housing/canopy interface according to the present invention.

Fasteners 42, as shown in FIG. 8, may also take the form of collars or keys 55 which fit into or about adaptations such as indentations 57 formed in posts 32 in order to retain housing 12 and canopy 28 together.

Figure 9:
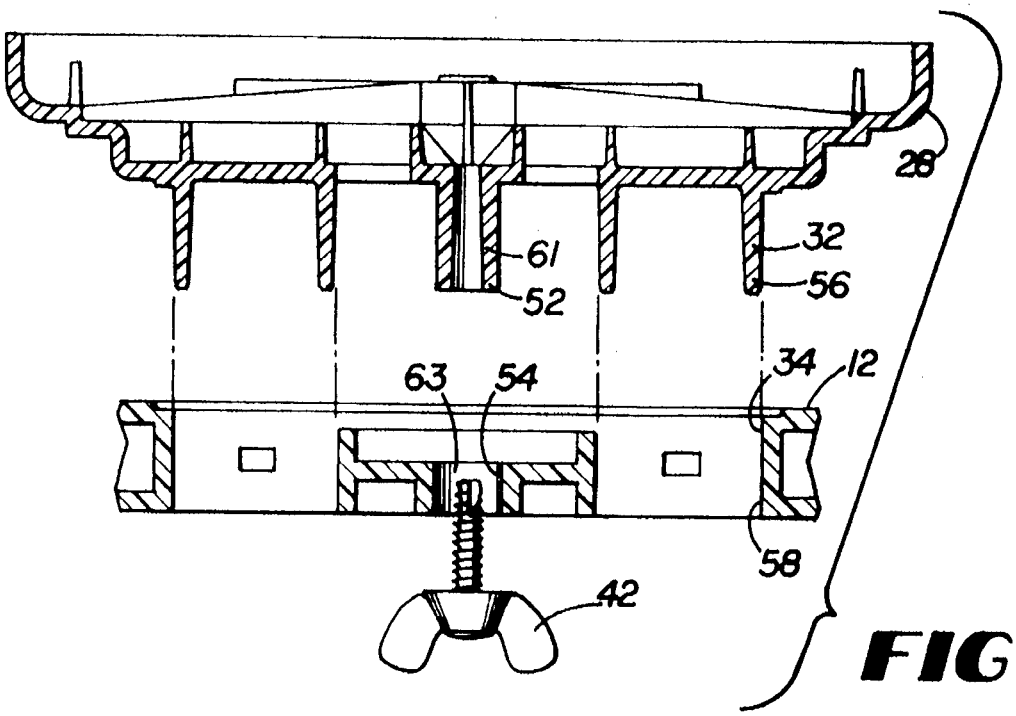
FIG. 9 is a cross sectional view of a fourth embodiment of a housing/canopy interface according to the present invention.

Fasteners 42, as shown in FIG. 9, may be adapted to be received by structure other than mounting posts 32, such as wingnut 59 which is received by canopy buttress 61 independent of the mounting posts 32.

Fasteners 42 may be received by and/or cooperate with any desired interconnecting structure between canopy 28 and housing 12. Generally, a first portion of such structure which forms portion of either canopy 12 or housing 28 may be referred to as a "first element," and cooperating structure on the other of the canopy and the housing may be referred to as the "second element." FIGS. 2–8 show, in nonlimiting fashion, first element 52 being mounting openings 34 and second elements 54 being mounting posts 32. FIG. 9 shows first element 52 as canopy buttress 61 and second element 54 being an opening 63 in housing 12.

Fasteners 42 may just as easily be received by and cooperate with adaptations 48 formed in structure of housing 12, whether or not the structure protrudes into, works with or receives structure formed of or in canopy 28. Such protrusion and reception may be thought of in terms of patrix elements and matrix elements. Again, although patrix element 56 includes mounting post 32 as shown in FIGS. 2–8 and matrix elements 58 include mounting openings 34 in those figures, patrix element 56 may protrude either from housing 12 or canopy 28 to be received by matrix elements 58 in the other.

However, as shown in FIG. 9, first elements 52 need not be received in second elements 54; they need only cooperate with a fastener 42 to retain housing 12 and canopy 28 together, even if they do not touch.

Additionally, fastener 42 may cooperate with structure either in a patrix element 56 or matrix element 58, a first element 52 or a second element 54, the only limiting principle being that it constitutes a separate structure from housing 12 and canopy 28 and may be installed into place to retain housing 12 against canopy 28 securely without the aid of tools. Fastener 42 may, in this sense, be screwed, slid, rotated, slid and rotated, cammed, snapped or otherwise positioned into place to create such retention. Any other desired form of retaining fastener 42 into place in order to retain housing 12 securely to canopy 28 may be employed.

FIGS. 2–6 show redundance members 36 in the form of barbed members formed adjacent to mounting posts 32 which capture portions of housing 12 in order to enhance simple and quick installation of fixtures 10, and for redundancy once in place. Any desired structure for redundance members 36 may be employed, whether or not snap fit. Redundance members 36 are not necessary; they need not be shown in FIGS. 1–6, and they are not shown in FIGS. 7–9.

Figure 7:
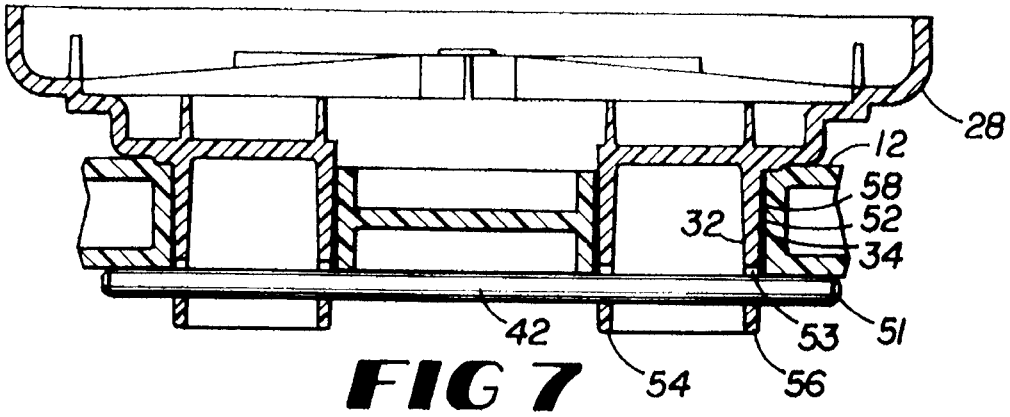
FIG. 7 is a cross-sectional view of a second embodiment of a housing/canopy interface according to the present invention.

As a first step in installation, canopy 28 may be connected or attached to a suitable support structure such as a junction box in a ceiling or wall. Appropriate wiring may be threaded through the canopy 28 structure shown, for instance, in FIGS. 2–6. Then, before or after its indicia 16 on faceplate or faceplates 14 have been adjusted as desired, housing 12 may be snapped onto mounting posts 32 using barbed members 36 as shown in FIGS. 2–6. Fasteners 42 may then be positioned to secure and/or bias housing 12 to canopy 28. Cammed member 44 as shown in FIGS. 2–6, for instance, may be snapped and rotated into place using tab 46. Or in other embodiments as shown in FIGS. 7–9 (which do not use barbed members 36), dowel 51 may be placed, keys 55 may be placed, or wingnut 42 may be rotated into place into buttress 61 to secure and/or bias housing 12 to canopy 28. Faceplates 14 may then be snapped into place to complete housing 12 and fixture 10.

The foregoing has been provided for purposes of illustration and disclosure of a preferred embodiment of the present invention. Other structure and modifications may be employed without departing from the scope or spirit of the present invention.

What is claimed is:

1. A lighting fixture comprising:

a. a housing which includes indicia and at least one illumination source for illuminating the indicia;

b. a canopy for connection to a mounting surface;

c. at least one matrix element formed in one of the housing and the canopy;

d. at least one patrix element connected to the other one of the housing and the canopy, which patrix element (1) is adapted in size and shape to be received by a corresponding matrix element and (2) the surface of the patrix element contains an adaptation for receiving a fastener; and e. the fastener is structurally separate from the housing and the canopy, and is adapted to be installed into place with the aid of no tools to bear against housing structure and against canopy structure to bias the housing and the canopy securely together.

2. A lighting fixture according to claim 1 in which the fastener includes an over-center structure.

3. A lighting fixture according to claim 1 in which the fastener bears against the patrix element and the housing structure.

4. A lighting fixture according to claim 1 in which the fastener bears against the patrix element and the matrix element.

5. A lighting fixture according to claim 1 in which the fastener includes an elongated, cammed member, the patrix element adaptations include slots for receiving the fastener, and the fastener is adapted to be inserted into and retained by the slots while cammed into place to bear against the housing and retain the housing and the canopy together.

6. A lighting fixture according to claim 1 in which the fastener comprises a pin, the patrix element adaptations include openings to receive the pin, and the pin is adapted to be inserted into the openings in order to retain the housing and the canopy together.

7. A lighting fixture according to claim 1 in which the fastener comprises a key, the patrix element adaptations include at least one keyway for receiving the key, and the key is adapted to bear against the housing and the patrix to retain the housing and the canopy together.

8. A lighting fixture according to claim 1 further comprising at least one snap fit redundance member for retaining the patrix element and the matrix element together.

9. A lighting fixture comprising:

a. a housing which includes indicia and at least one illumination source for illuminating the indicia;

b. a canopy for connection to a mounting surface;

c. at least one first element forming a part of one of the housing and the canopy; and d. at least one second element forming a part of the other of the housing and the canopy, which second element is adapted to be received by a first element;

e. at least one adaptation included in at least one of the first and second elements for retaining a fastener; and f. the fastener is adapted to be received by and cooperate with the adaptation to retain the canopy and the housing together, and adapted to be positioned into place without the aid of tools to bias the canopy and the housing together securely.

10. A lighting fixture according to claim 9 further comprising at least one redundance member connected to at least one of the elements for redundantly retaining the canopy and the housing together.

11. A lighting fixture according to claim 9 further comprising at least one patrix member forming a part of the canopy and at least one matrix member forming a part of the housing, and in which neither the first or second elements form part of either the matrix or patrix members.

12. A lighting fixture according to claim 9 in which the first elements comprise mounting openings formed in the housing and the second elements comprise mounting posts extending from the canopy.

13. A lighting fixture according to claim 9 in which the fastener includes an over-center structure.

14. A lighting fixture according to claim 9 in which the fastener bears against at least one of the elements and the housing structure.

15. A lighting fixture according to claim 9 in which the fastener bears against both first and second elements.

16. A lighting fixture according to claim 9 in which the fastener includes an elongated, cammed member, the adaptations include slots for receiving the fastener, and the fastener is adapted to be inserted into and retained by the slots while cammed into place to bear against the housing and retain the housing and the canopy together.

17. A lighting fixture according to claim 9 in which the fastener comprises a pin, the adaptations include openings to receive the pin, and the pin is adapted to be inserted into the openings in order to retain the housing and the canopy together.

18. A lighting fixture according to claim 9 in which the fastener comprises a key, the adaptations include at least one keyway for receiving the key, and the key is adapted to bear against the housing and the patrix to retain the housing and the canopy together.

19. A lighting fixture comprising:

a. a housing which includes indicia and at least one illumination source for illuminating the indicia, and at least one mounting opening;

b. a canopy for connection to a mounting surface and featuring at least one mounting post (1) which is adapted in size and shape to be received by a corresponding mounting opening of the housing and (2) whose surface contains an adaptation for receiving a fastener;

c. at least one redundance member for retaining the mounting post of the canopy in the mounting opening of the housing, which redundance member comprises a snap form adjacent to at least one of the mounting posts and which snap form redundance member is adapted to cooperate with opening; and d. a fastener adapted to cooperate with the canopy mounting post adaptation for securing the canopy to the housing.

20. A lighting fixture according to claim 19 in which the redundance member is adapted to snap into place as the mounting post enters the mounting opening in a manner that retains the canopy and the housing together.

21. A lighting fixture according to claim 19 in which the adaptation of the mounting post forms at least one indentation in the post.

22. A lighting fixture according to claim 19 in which the adaptation of the mounting post forms at least one opening in the post.

23. A lighting fixture according to claim 21 in which the fastener is adapted in size and shape to cooperate with the indentation in securing the mounting post in the mounting opening.

24. A lighting fixture according to claim 22 in which the fastener is adapted in size and shape to penetrate the opening and secure the mounting post into the mounting opening.

25. A lighting fixture according to claim 19 in which the adaptation comprises at least one substantially L-shaped opening and the fastener comprises a member which is adapted to snap into the L-shaped opening to secure the mounting post and mounting opening together.

26. A lighting fixture according to claim 19 in which the adaptation comprises at least one substantially L-shaped opening and the fastener comprises a locking pin which features an elongated, cammed surface, at least one positioning tab, and is adapted in size and shape to snap into the substantially L-shaped opening, and be rotated into place with the positioning tab to cam the mounting post and the opening, and thus the housing and the canopy, together.

27. A lighting fixture comprising:

a. a housing which includes indicia and at least one illumination source for illuminating the indicia, and at least one mounting opening;

b. a canopy for connection to a mounting surface and featuring at least one mounting post (1) which is adapted in size and shape to be received by a corresponding mounting opening of the housing and (2) the surface of the post contains an adaptation for receiving a fastener; and c. the fastener does not form a part of the housing or the canopy, is adapted to be received by and cooperate with the canopy mounting post adaptation for securing the canopy to the housing and is adapted to be installed without tools to bias the housing against the canopy securely.

28. A lighting fixture according to claim 27 in which the fastener includes an elongated, cammed member, the adaptations include slots for receiving the fastener, and the fastener is adapted to be inserted into and retained by the slots while cammed into place to bear against the housing and retain the housing and the canopy together.

29. A lighting fixture according to claim 27 in which the fastener comprises a pin, the adaptations include openings to receive the pin, and the pin is adapted to be inserted into the openings in order to retain the housing and the canopy together.

30. A lighting fixture according to claim 27 in which the fastener comprises a key, the adaptations include at least one keyway for receiving the key, and the key is adapted to bear against the housing and the patrix to retain the housing and the canopy together.

31. A lighting fixture according to claim 27 in which the adaptation comprises at least one substantially L-shaped opening and the fastener comprises a locking pin which features an elongated, cammed surface, at least one positioning tab, and is adapted in size and shape to snap into the substantially L-shaped opening, and be rotated into place with the positioning tab to cam the mounting post and the opening, and thus the housing and the canopy, together.

32. A lighting fixture according to claim 27 further comprising at least one redundance member attached to at least one of the canopy and the housing and adapted to retain the housing and the canopy together, redundant to the fastener.

* * * * *

UNITED STATES PATENT AND TRADEMARK OFFICE

CERTIFICATE OF CORRECTION

PATENT NO. : 5,526,251

DATED : June 11, 1996

INVENTOR(S) : Gary S. Andre, Andrew E. Masters, Stephen T. Smith

It is certified that error appears in the above-indentified patent and that said Letters Patent is hereby corrected as shown below:

Claim 19, Column 7, Line 15, before the word "opening" insert -- the mounting --

Signed and Sealed this

Twenty-second Day of October, 1996

Bruce Lehman

*Attest:*

BRUCE LEHMAN

*Attesting Officer*

*Commissioner of Patents and Trademarks*